US007746334B2

(12) United States Patent
Lee et al.

(10) Patent No.: US 7,746,334 B2
(45) Date of Patent: Jun. 29, 2010

(54) APPARATUS AND METHOD FOR DRIVING LIQUID CRYSTAL DISPLAY DEVICE

(75) Inventors: Dong Hoon Lee, Fairfax, VA (US); Juhn Suk Yoo, Seoul (KR); Chul Sang Jang, Anyang-si (KR); Oh Kyong Kwon, Seoul (KR)

(73) Assignee: LG. Display Co., Ltd., Seoul (KR)

( * ) Notice: Subject to any disclaimer, the term of this patent is extended or adjusted under 35 U.S.C. 154(b) by 750 days.

(21) Appl. No.: 11/139,440

(22) Filed: May 27, 2005

(65) Prior Publication Data

US 2005/0280622 A1 Dec. 22, 2005

(30) Foreign Application Priority Data

May 28, 2004 (KR) ..... 10-2004-0038421

(51) Int. Cl.
*G06F 3/033* (2006.01)

(52) U.S. Cl. ..... 345/209; 345/96; 345/98; 345/204

(58) Field of Classification Search ..... 345/96, 345/98, 209, 930, 55, 84, 87, 204
See application file for complete search history.

(56) References Cited

U.S. PATENT DOCUMENTS

| | | | | |
|---|---|---|---|---|
| 6,448,953 | B1 * | 9/2002 | Murade | 345/98 |
| 7,319,450 | B2 * | 1/2008 | Choi | 345/92 |
| 2002/0126083 | A1 * | 9/2002 | Cairns et al. | 345/98 |

* cited by examiner

*Primary Examiner*—Henry N Tran
*Assistant Examiner*—Christopher E Leiby
(74) *Attorney, Agent, or Firm*—Brinks Hofer Gilson & Lione

(57) ABSTRACT

A driving apparatus of a liquid crystal display device includes a liquid crystal display panel display a video signal by use of a liquid crystal cell of a matrix shape. A plurality of data drive circuits generate a polarity pattern of the video signal in accordance with a polarity signal and supply the polarity pattern to the liquid crystal cell through a plurality of output channels. A polarity controller controls the polarity signal and supplies the polarity signal to the data drive circuits on the basis of a first selection signal corresponding to the number of the output channels of one drive circuit and a second selection signal corresponding to a repetition period of the polarity pattern.

13 Claims, 14 Drawing Sheets

FIG.8

| Dot | Chsel | POL | |
|---|---|---|---|
| | | Odd Data D-IC | Eevn Data D-IC |
| L | L | POL | POL |
| L | H | POL | POL |
| H | L | POL | IPOL |
| H | H | POL | POL |

Dot = "L" → ONE-DOT INVERSION

Dot = "H" → TWO-DOT INVERSION

Chsel = "L" → 414 OUTPUT CHANNELS

Chsel = "H" → 384 OUTPUT CHANNELS

APPARATUS AND METHOD FOR DRIVING LIQUID CRYSTAL DISPLAY DEVICE

This application claims the benefit of Korean Patent Application No. P2004-38421 filed on May 28, 2004, which is hereby incorporated by reference.

TECHNICAL FIELD

The present application relates to a liquid crystal display device, and more particularly to a driving apparatus and method of a liquid crystal display device.

BACKGROUND

Generally, a liquid crystal display device controls the light transmissivity of a liquid crystal by use of an electric field, thereby displaying a picture or other visual data. For this purpose, the liquid crystal display device includes a liquid crystal display panel where liquid crystal cells are arranged in an active matrix shape, and a drive circuit to drive the liquid crystal display panel.

The liquid crystal display device, as shown in FIG. 1, includes a liquid crystal display panel 6 to display a picture in accordance with the polarity pattern of a pixel signal; a data drive integrated circuit D-IC 10 to drive data lines of the liquid crystal display panel 6 is mounted on a data tape carrier package TCP 8; a gate drive integrated circuit D-IC 12 to drive gate lines of the liquid crystal display panel 6 is mounted on a TCP 4; and a timing controller 30 to control the driving of the plurality of data D-ICs 10 and the plurality of gate D-ICs 12.

The liquid crystal display panel 6 includes a liquid crystal layer formed between an upper substrate 5 and a lower substrate 3, and a spacer to maintain a fixed distance between the upper substrate 5 and the lower substrate 3. A color filter, a common electrode, a black matrix and soon are formed in the upper substrate 5 of the liquid crystal display panel 6, as is known in the art. The common electrode can be formed on the lower substrate 3. Further, the lower substrate 3 of the liquid crystal display panel 6 includes a thin-film transistor (TFT) formed at each of intersections of the gate lines and the data lines, and a liquid crystal cell connected to the thin-film transistor. A gate electrode of the thin-film transistor is connected to any one of the horizontal gate lines, and a source electrode is connected to any one of the vertical data lines. The thin-film transistor supplies a pixel signal from the data line to the liquid crystal cell in response to a scan signal from the gate line. The liquid crystal cell includes a pixel electrode connected to a drain electrode of the thin-film transistor, and a common electrode facing the pixel electrode with a liquid crystal layer therebetween. The liquid crystal cell drives the liquid crystal layer in response to the pixel signal supplied to the pixel electrode, thereby controlling the light transmissivity.

In order to drive the liquid crystal cells on the liquid crystal display panel 6, inversion driving methods such as a frame inversion system, a line inversion system and a dot inversion system are used. In the driving method of the frame inversion system, the polarity of the pixel signals supplied to the liquid crystal cells on the liquid crystal display panel 6 is inverted from frame to frame. In the line inversion driving method, the polarity of the pixel signals supplied to the liquid crystal-cells is inverted in accordance with the line on the liquid crystal display panel 6. The dot inversion system has a polarity of the pixel voltage signal supplied which is opposite to the polarity of the pixel signal voltage supplied to the liquid crystal cells that are adjacent to the liquid crystal cells on the liquid crystal display panel 6 in the vertical and horizontal directions The polarity of the pixel signals supplied to all the liquid crystal cells on the liquid crystal display panel 6 is inverted from frame to frame. Such an inversion method is performed by having the data D-IC 10 responded in accordance with a polarity signal POL supplied to each of the data D-IC 10 from the timing controller 30.

The liquid crystal display device is driven at a frame repetition frequency of 60 Hz. But, in a system like a notebook which consumes low power it is necessary to lower the frame repetition frequency to 50~30 Hz. As the frame repetition frequency gets lower, a Greenish optical phenomenon is generated even in the dot inversion system which may provide the best picture quality among the inversion methods. Horizontal 2-dot inversion systems and square inversion systems have also been suggested.

In the horizontal 2-dot inversion system, the polarity of the pixel signal is changed for one dot in a vertical direction, while it is changed for two dots in a horizontal direction and, in addition, the polarity of the pixel signals supplied to all the liquid crystal cells on the liquid crystal display panel 6 are inverted from frame to frame. In the square inversion system, the polarity of the pixel signal is changed for two dots in a vertical direction and it is also changed for two dots in a horizontal direction and, in addition, the polarity of the pixel signals supplied to all the liquid crystal cells on the liquid crystal display panel 6 is inverted from frame to frame.

In this way, in case of the one dot inversion system, the polarity of the pixel signal supplied to the liquid crystal cell repeats for the two liquid crystal cells in the horizontal direction. On the other hand, in case of the two dot inversion system, the polarity of the pixel signal supplied to the liquid crystal cell repeats for four liquid crystal cells in the horizontal direction, and in case of the square inversion system, the polarity of the pixel signal supplied to the liquid crystal cell repeats by for four liquid crystal cells in the vertical and horizontal directions.

The timing controller 30 generates gate control signals such as GSP, GSC, GOE and so on, which control the drive of the gate D-IC 4, and generates data control signals such as SSP, SSC, SOE, POL and so on, which control the drive of the data IC 10. Further, the timing controller 30 aligns the data signal supplied from the system to fit the data signal for the drive of the liquid crystal display panel 6, and supplies the aligned data signal to a plurality of data D-IC 10.

The timing controller 30 is mounted on a data PCB (printed circuit board) 20. The data PCB 20 is connected to an external system through a user connector. On the data PCB 20, signal lines are formed to supply various control signals and data signals from the timing controller 30 to each of the data D-IC 10 and the gate D-IC 12.

Each of the gate D-IC 12 is mounted on gate TCP 4. The gate D-IC 12 mounted on the gate TCP 4 is electrically connected to the gate pads of the liquid crystal display panel 6 through the gate TCP 4. The plurality of gate D-IC 12 sequentially drives the gate lines of the liquid crystal display panel 6 during one horizontal period (1H). The gate TCP 4 is connected to a gate PCB 26. The gate PCB 26 supplies the gate control signals from the timing controller 30 through the data PCB 20 to the plurality of gate D-IC 12 through the gate TCP 4.

Each of the data D-IC 10 is mounted on each of the data TCP 8. The data D-IC 10 mounted on the data TCP 8 is electrically connected to the data pads of the liquid crystal display panel 6 through the data TCP 8. The data D-IC 10 convert digital pixel data into an analog pixel signal to supply the converted pixel signal to the data lines of the liquid crystal display panel 6.

In this way, in the driving device of the related art liquid crystal display device, the repetition period of the pixel signal polarity becomes uniform or non-uniform in accordance with the number of the output channels of the data D-IC 10 and the inversion method of the polarity pattern of the pixel signal supplied to the liquid crystal display panel 6.

Specifically, the data D-IC 10 having even-numbered output channels might output signal voltages such that the polarity of the pixel signal has the polarity pattern of the one dot inversion system regardless of the number of output channels of the data D-IC 10. As shown in FIG. 2, when the pixel signal having the polarity pattern of the one dot inversion system is supplied to the liquid crystal display panel 6 by use of the data D-IC 10 having 384 (a multiple of 4) output channels (Ch1 to Ch384), the polarity of the pixel signal between the last output channel Ch384 of the odd-numbered data D-IC 10 and the first output channel Ch1 of the even-numbered data D-IC 10 is not equal but inverted. That is, the polarity of the pixel signal outputted from the last output channel Ch384 of the odd-numbered data D-IC 10 is "−", and the polarity of the pixel signal outputted from the first output channel Ch1 of the even-numbered data D-IC 10 is "+".

Also, in case that the pixel signal having the polarity pattern of the one dot inversion system is supplied to the liquid crystal display panel 6 by use of the data D-IC 10 having 414 (a multiple of 2, but not a multiple of 4) output channels (Ch1 to Ch414), the polarity of the pixel signal between the last output channel Ch384 of the odd-numbered data D-IC 10 and the first output channel Ch1 of the even-numbered data D-IC 10 is not equal but inverted. Accordingly, the driving method of the liquid crystal display panel 6 by the one dot inversion system in use of the data D-IC 10 having the output channels, which are a multiple of 2 and not a multiple of 4, is driven to have the polarity pattern of the exact one dot inversion system.

As shown in FIG. 3, in case of the pixel signal having the polarity pattern of the horizontal two dot inversion system is supplied to the liquid crystal display panel 6 by use of the data D-IC 10 having 384 (a multiple of 4) output channels (Ch1 to Ch384), the polarity of the pixel signal between the last two output channels Ch 383, Ch384 of the odd-numbered data D-IC 10 and the first and second output channels Ch1, Ch2 of the even-numbered data D-IC 10 is not equal but inverted. In other words, the polarity of the pixel signal outputted from the last two output channels Ch383, Ch384 of the odd-numbered data D-IC 10 is "−−", and the polarity of the pixel signal outputted from the first and second output channels Ch1, Ch2 of the even-numbered data D-IC 10 is "++". Accordingly, the driving method of the liquid crystal display panel 6 by the two dot inversion system in use of the data D-IC 10 having the output channels, of which the number is the multiple of 4, is driven to have the polarity pattern of the exact horizontal two dot inversion system.

On the other hand, as shown in FIG. 4, in case that the pixel signal having the polarity pattern of the horizontal two dot inversion system is supplied to the liquid crystal display panel 6 by use of the data D-IC 10 having 414 (a multiple of 2, but not a multiple of 4) output channels (Ch1 to Ch414), the polarity of the pixel signal between the last two output channels Ch 413, Ch414 of the odd-numbered data D-IC 10 and the first and second output channels Ch1, Ch2 of the even-numbered data D-IC 10 is equal. Specifically, in case that the polarity of the pixel signal outputted from the first and second output channels Ch1, Ch2 of the data D-IC 10 having the output channels, of which the number is the multiple of 2, starts with "++", the polarity of the pixel signal outputted from the first and second output channels Ch1, Ch2 of each of the odd-numbered data D-IC 10 and the even-numbered data D-IC 10 starts with "++". Hence, the polarity of the pixel signal outputted from the last two output channels Ch413, Ch414 of the odd-numbered data D-IC 10 is "++", and the polarity of the pixel signal outputted from the first and second output channels Ch1, Ch2 of the even-numbered data D-IC 10 is "++". Accordingly, in case of driving the liquid crystal display panel 6 by the two dot inversion system in use of the data D-IC 10 having a number of output channels which is a multiple of 2, the same polarity of pixel signal is supplied to the four liquid crystal cells which are a bordering area between the adjacent data D-IC 10.

Therefore, as shown in FIG. 4, in case that the number of the output channels of the data D-IC 10 is a multiple of 2 but not a multiple of 4, the repetition period of the pixel signal polarity is non-uniform at a bordering area A between the adjacent odd and even data D-IC's 10 and may result a picture quality defect such as a vertical line in the liquid crystal display device using the related art horizontal two dot inversion system.

As shown in FIG. 5, in case that the pixel signal having the polarity pattern of the square inversion system and where the data D-IC 10 have 414 (a multiple of 2, but not a multiple of 4) output channels Ch1 to Ch414, the polarity of the pixel signal between the last two output channels Ch 413, Ch414 of the odd-numbered data D-IC 10 and the first and second output channels Ch1, Ch2 of the even-numbered data D-IC 10 of $j^{th}$ (but, j is a positive integer) and $(j+1)^{th}$ horizontal lines is equal. Specifically, in case that the polarity of the pixel signal outputted from the first and second output channels Ch1, Ch2 of the data D-IC 10 having the output channels, the number of output channels being a multiple of 2, starts with "++", the polarity of the pixel signal outputted from the first and second output channels Ch1, Ch2 of each of the odd-numbered data D-IC 10 and the even-numbered data D-IC 10 of each of the $j^{th}$ and $(j+1)^{th}$ horizontal lines starts with "++". As such, the polarity of the pixel signal outputted from the last two output channels Ch413, Ch414 of the odd-numbered data D-IC 10 of each of the $j^{th}$ and $(j+1)^{th}$ horizontal lines is "++", and the polarity of the pixel signal outputted from the first and second output channels Ch1, Ch2 of the even-numbered data D-IC 10 of each of the $j^{th}$ and $(j+1)^{th}$ horizontal lines is "++". Accordingly, in case of driving the liquid crystal display panel 6 by the square inversion system in use of the data D-IC 10 having output channels, the number of output channels being a multiple of 2 but not of 4, the same polarity of the pixel signal is supplied to the eight liquid crystal cells which are a bordering area between the adjacent data D-IC's 10.

Therefore, as shown in FIG. 5, in case that the number of the output channels of the data D-IC 10 is not a multiple of 4, the repetition period of the pixel signal polarity is non-uniform at a bordering area A between the adjacent data D-IC 10 and results in a picture quality degradation such as a vertical line in the liquid crystal display device using the related art square inversion system.

SUMMARY

A liquid crystal display device is described, which includes: a liquid crystal display panel to display a video signal by use of liquid crystal cells disposed in a matrix shape; a plurality of data drive circuits that generate a polarity pattern of the video signal in accordance with a polarity signal and supply the video signal to the liquid crystal cells through a plurality of output channels; a timing controller that supplies the video signal to the data drive circuits and generates the polarity signal; and a polarity controller which is embedded in the timing controller and that controls the polarity signal and supplies the polarity signal to the data drive circuits based on a first selection signal corresponding to the number of the output channels and a second selection signal corresponding to a spatial repetition period of the polarity pattern.

The polarity controller includes: a decoder to generate the polarity signal based on the first selection signal and the second selection signal; a polarity distributor that receives the polarity signal from the decoder, converts it into at least one of a polarity and an inverted polarity signal and then supplies the polarity signal to the data drive circuits.

The polarity distributor supplies a polarity signal to an odd-numbered data drive circuit among the plurality of data drive circuits, and supplies at least one of a polarity signal and an inverted polarity signal to an even-numbered data drive circuit among the plurality of data drive circuits, in accordance with the polarity pattern.

The polarity controller includes: a first input terminal to which the first selection signal is supplied; a second input terminal to which the second selection signal is supplied; and a third input terminal to which the polarity signal is supplied.

A driving apparatus of a liquid crystal display device according to another aspect includes: a liquid crystal display panel to realize a video signal by use of a liquid crystal cell of a matrix shape; a plurality of data drive circuits that generate a polarity pattern of the video signal in accordance with a polarity signal and supply it to the liquid crystal cell through a plurality of output channels; a logic signal generator to generate a logic signal that controls the polarity signal; and a polarity controller to convert the polarity signal in accordance with the logic signal, the polarity signal based on a first selection signal corresponding to the number of the output channels and a second selection signal corresponding to a spatial repetition period of the polarity pattern, and to supply the polarity signal to the data drive circuits.

The logic signal includes: a first logic signal not to invert the polarity signal; and, a second logic signal to invert the polarity signal.

The polarity controller supplies the first logic signal to an odd-numbered data drive circuit among the plurality of data drive circuits, and supplies at least one of the first logic signal and the second logic signal to an even-numbered data drive circuit, in accordance with the polarity signal.

The polarity controller further includes: a first input terminal to which the first selection signal is supplied; a second input terminal to which the second selection signal is supplied; a third input terminal to which the polarity signal is supplied; and a fourth input terminal to which the logic signal is supplied.

The polarity pattern is at least one of a first polarity pattern that is alternated by one liquid crystal cell in horizontal and vertical directions of the liquid crystal display panel, a second polarity pattern that is alternated by two liquid crystal cells in the horizontal direction of the liquid crystal display panel and by the one liquid crystal cell in the vertical direction of the liquid crystal display panel, and a third polarity pattern that is alternated by the two liquid crystal cells in both the horizontal and vertical directions of the liquid crystal display panel.

A driving method of a liquid crystal display device having a liquid crystal display panel which includes liquid crystal cells disposed in a matrix shape to display a video signal, a plurality of data drive circuits that generate a polarity pattern of the video signal to supply it to the liquid crystal cell through a plurality of output channels, and a timing controller to control the data drive circuits, including the steps of: generating a polarity signal on the basis of a repetition period of the polarity pattern and the number of the output channels; and generating the polarity pattern of the video signal in accordance with the polarity signal by controlling the polarity signal in accordance with the number of the output channels, by use of a polarity controller embedded in the timing controller.

The step of generating the polarity pattern is any one of the step of generating a first polarity pattern where positive and negative polarities are alternated by one liquid crystal cell in horizontal and vertical directions of the liquid crystal display panel, the step of generating a second polarity pattern where positive and negative polarities are alternated by two liquid crystal cells in the horizontal direction of the liquid crystal display panel and by the one liquid crystal cell in the vertical direction of the liquid crystal display panel, or the step of generating a third polarity pattern where positive and negative polarities are alternated by two liquid crystal cells in the horizontal and vertical directions of the liquid crystal display panel.

The step of generating the polarity pattern further comprises: generating a first selection signal that is at least one of a first logic state corresponding to the number of the output channels and a second logic state being different from the first logic state; generating a second selection signal of the first logic state corresponding to the first to third polarity patterns; and generating the second selection signal of the second logic state corresponding to a polarity pattern, of which the state is different from the first logic state.

The step of controlling the polarity signal in accordance with the number of output channels by use of the polarity controller embedded in the timing controller includes the steps of: generating any one of the polarity signal of the first logic state and the polarity signal of the second logic state, which is inverted from the first polarity state, by use of a decoder; and supplying the first logic signal to an odd-numbered data drive circuit among the data drive circuits and supplying at least one of the polarity signals of the first and second logic states to an even-numbered data drive circuit, by use of a polarity distributor.

In another aspect, a driving method of a liquid crystal display device having a liquid crystal display panel which includes liquid crystal cells disposed in a matrix shape to display a video signal, and a plurality of data drive circuits that generates a polarity pattern of the video signal to supply the polarity-patterned video signal to the liquid crystal cells through a plurality of output channels, includes the steps of: generating a polarity signal on the basis of a spatial repetition period of the polarity pattern and the number of the output channels; generating any one of a first logic signal and a second logic signal that is different from the first logic signal; controlling the polarity signal in accordance with the first and second logic signals according to the number of the output channels by use of polarity controller included in the data drive circuit; and generating the polarity pattern of the video signal in accordance with the polarity signal supplied from the polarity controller.

The step of generating the polarity pattern is any one of the step of generating a first polarity pattern where positive and negative polarities are alternated by one liquid crystal cell in horizontal and vertical directions of the liquid crystal display panel; the step of generating a second polarity pattern where positive and negative polarities are alternated by two liquid crystal cells in the horizontal direction of the liquid crystal display panel and by one liquid crystal cell in the vertical direction of the liquid crystal display panel, or the step of generating a third polarity pattern where positive and negative polarities are alternated by the two liquid crystal cells in the horizontal and vertical directions of the liquid crystal display panel.

The step of generating the polarity signal on the basis of the repetition period of the polarity pattern and the number of the output channels includes the steps of: generating a first selection signal that is at least one of the first logic state and the second logic state; generating a second selection signal of the first logic state corresponding to the first to third polarity patterns; and generating the second selection signal of the second logic state which is different from the first logic state.

The step of generating any one of the first logic signal and the second logic signal includes the step of: supplying the first logic signal to an odd-numbered data drive circuit among the data drive circuits and supplying at least one of the first and second logic signals to an even-numbered data drive circuit, on the basis of the first selection signal and the second selection signal.

The step of controlling the polarity signal in accordance with the first and second logic signals, wherein the polarity signal is generated on the basis of the first and second selection signals in accordance with the number of the output channels by use of the polarity controller embedded in the data drive circuit, includes any one of the steps of: determining the polarity signal of the data drive circuit as a polarity signal corresponding to the first logic signal; or determining an inverted polarity signal in comparison with a polarity signal corresponding to the first logic signal by having the polarity signal of the data drive circuit correspond to the second logic signal.

BRIEF DESCRIPTION OF THE DRAWINGS

FIG. 8 is a diagram representing a polarity signal outputted in accordance with an input signal supplied to a decoder shown in FIG. 7;

DETAILED DESCRIPTION

Exemplary embodiments may be better understood with reference to the drawings, but these examples are not intended to be of a limiting nature. Like numbered elements in the same or different drawings perform equivalent functions.

The terms "dots" and "pixels" are generally used interchangeably to connote an individual data cell or a discrete displayed data point. In a color display, the pixel may be comprised of R, G, and B sub-pixels. The same apparatus and methods may be used where each of the R, G, B components of a pixel are considered as sub-pixels, and the apparatus and method are adapted to provide a similar arrangement and function at the sub-pixel level.

Figure 1:
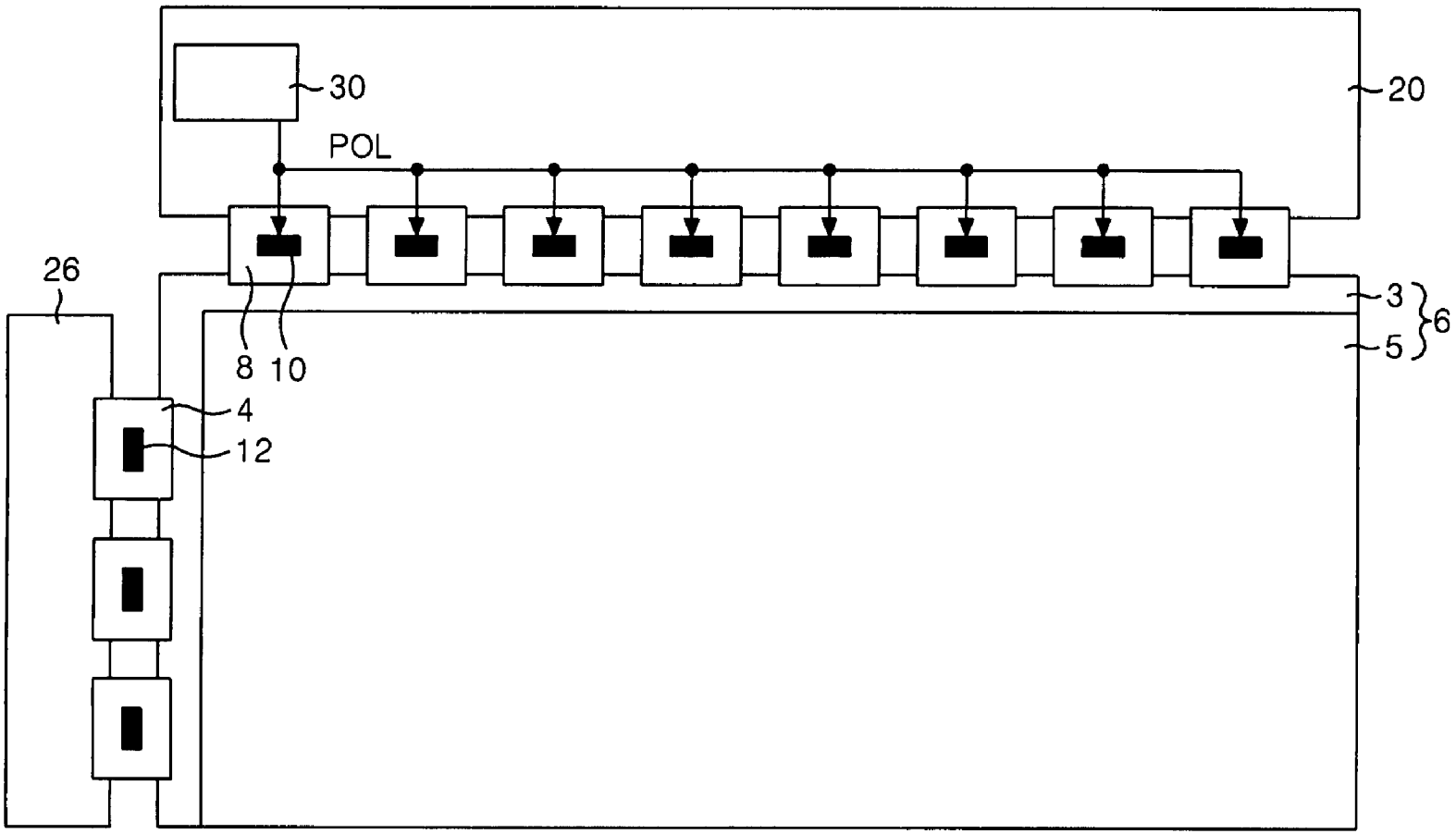
FIG. 1 is a diagram illustrating a driving apparatus of a related art liquid crystal display device.
Figure 2:
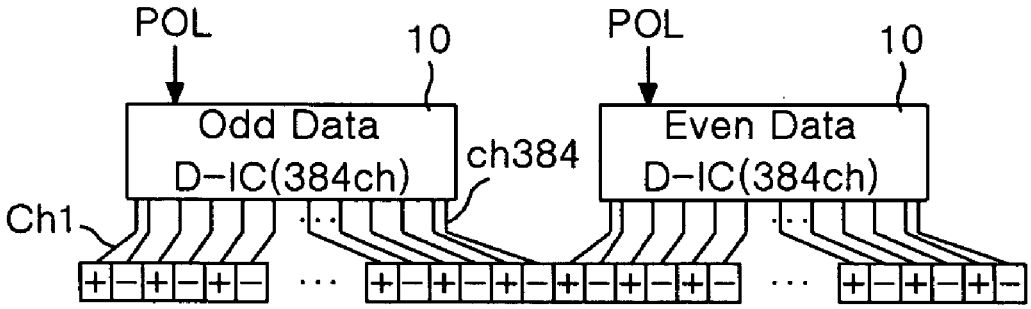
FIG. 2 is a diagram illustrating that a liquid crystal display panel shown in FIG. 1 is driven by a one-dot inversion system.
Figure 3:
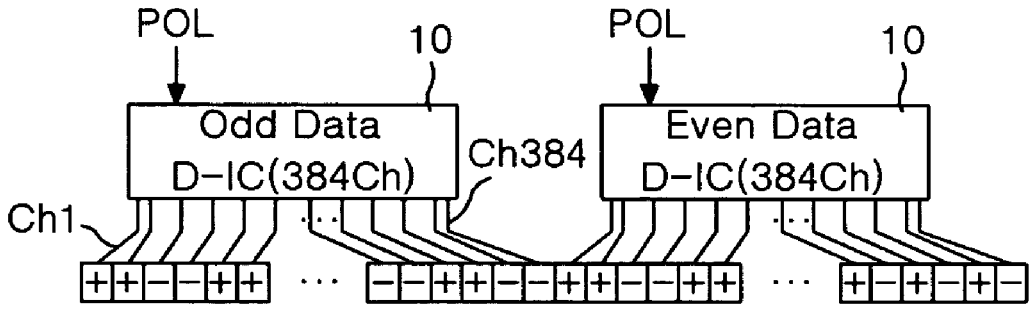
FIG. 3 is a diagram illustrating that adjacent data D-IC's having output channels, of which the number is a multiple of 4, shown in FIG. 1 are driven by a polarity pattern of a two-dot inversion system.
Figure 4:
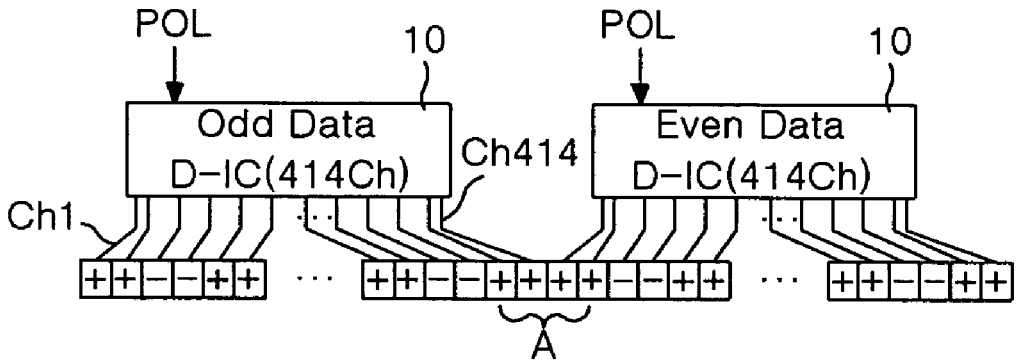
FIG. 4 is a diagram illustrating that adjacent data D-IC's having output channels, of which the number is a multiple of 2, shown in FIG. 1 are driven by a polarity pattern of a two-dot inversion system.
Figure 5:
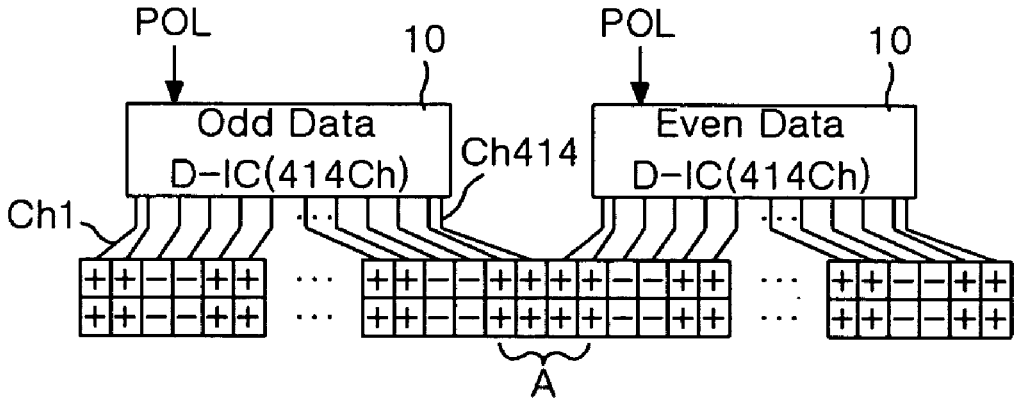
FIG. 5 is a diagram illustrating that adjacent data D-IC's having output channels, of which the number is a multiple of 2, shown in FIG. 1 are driven by a polarity pattern of a square inversion system.
Figure 6:
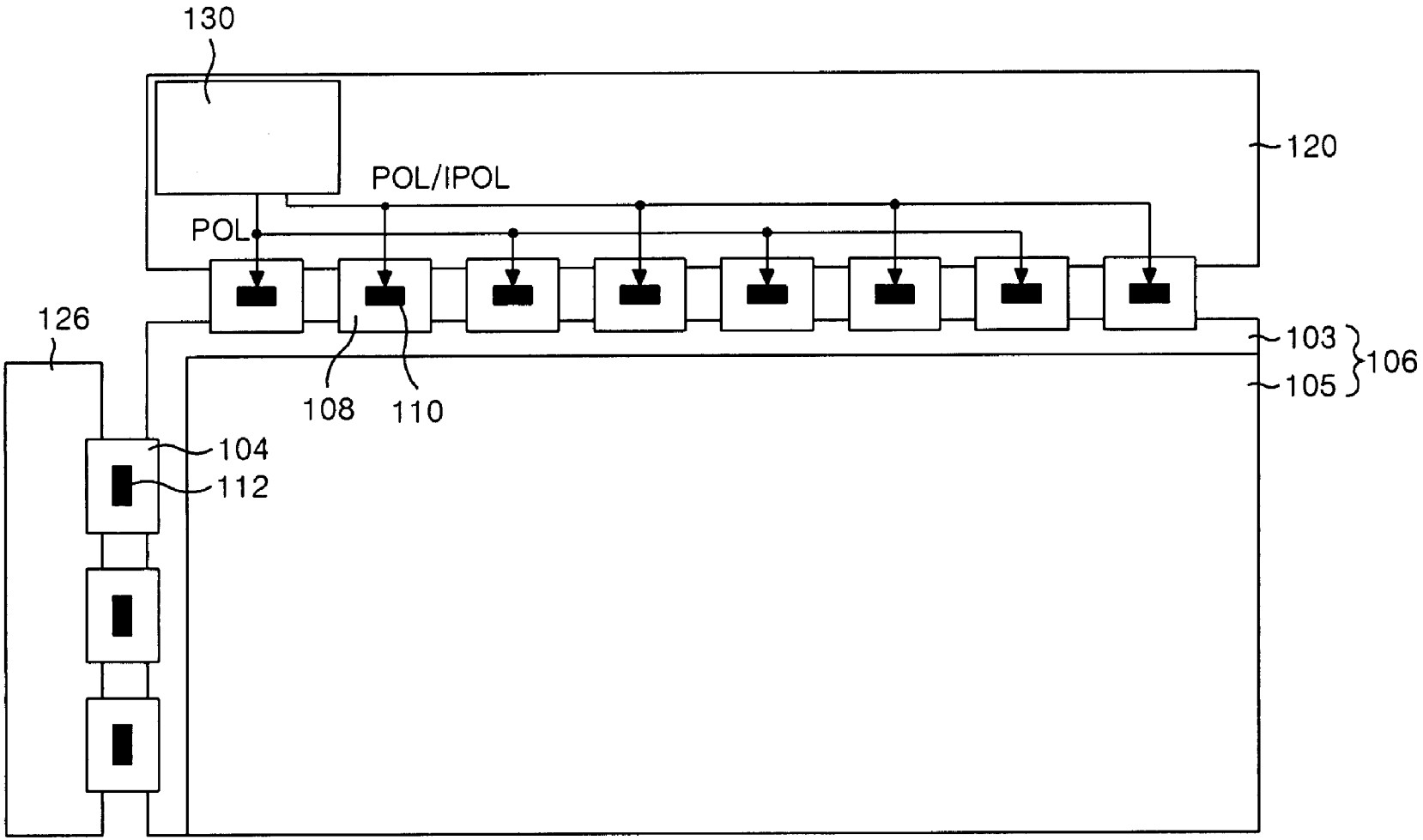
FIG. 6 is a diagram illustrating a driving apparatus of a liquid crystal display device according to a first embodiment.

A driving apparatus of a liquid crystal display device according to a first embodiment shown in FIG. 6 includes a liquid crystal display panel 106 to display a picture in accordance with the polarity pattern of a pixel signal; a plurality of data tape carrier packages (TCP) on which a data drive integrated circuit D-IC 110 for driving data lines of the liquid crystal display panel 106 is mounted; a plurality of gate TCP 104 on which a gate D-IC 112 for driving gate lines of the liquid crystal display panel 106; a timing controller 130 to control the drive of the data D-IC 110 and the gate D-IC 112 and to supply by changing a polarity signal POL on the basis of the polarity pattern of the pixel signal displayed in the liquid crystal display panel 106 and the number of output channels of the data D-IC 110.

The liquid crystal display panel 106 includes a liquid crystal layer formed between an upper substrate 105 and a lower substrate 103 and a spacer to maintain the distance between the upper substrate 105 and the lower substrate 103. A color filter, a common electrode, a black matrix and other elements of the LCD panel 106 are formed in the upper substrate 105 of the liquid crystal display panel 106. A common electrode can be formed in the lower substrate 103 of the liquid crystal display panel 106. Further, the lower substrate 103 of the liquid crystal display panel 106 includes a thin-film transistor (TFT) formed at every intersection of the gate lines and the data lines, and a liquid crystal cell connected to the thin-film transistor. A gate electrode of the thin-film transistor is connected a gate line of a horizontal line, and a source electrode is connected a data line of vertical line. The thin-film transistor responds to a scan signal from the gate line to supply a pixel signal from the data line to the liquid crystal cell. The liquid crystal cell includes a pixel electrode connected to a drain electrode of the thin-film transistor and a common electrode opposing the pixel electrode with the liquid crystal layer therebetween. The liquid crystal cell responds to the pixel signal voltage supplied to the pixel electrode to drive the liquid crystal layer, thereby controlling the LCD light transmissivity.

In order to drive the liquid crystal cells on the liquid crystal display panel 106, one of an inversion driving method such as a frame inversion system, a line inversion system or a dot inversion system is used. The driving method of the frame inversion system inverts the polarity of the pixel signals supplied to the liquid crystal cells on the liquid crystal display panel 106 from frame to frame. The driving method of the line inversion system makes inverts the polarity of the pixel signals supplied to the liquid crystal cells in accordance with the line on the liquid crystal display panel 106. The dot inversion system inverts the pixel voltage signal with respect to the polarity of the pixel signals supplied to the adjacent liquid crystal cells in vertical and horizontal directions to the liquid crystal cells of the liquid crystal display panel 106. In addition, the polarity of the pixel signals supplied to all the liquid crystal cells on the liquid crystal display panel 106 is inverted from frame to frame.

In the horizontal two dot inversion system, the liquid crystal display panel 106 is driven so that the polarity of the pixel signal is changed by a dot in a vertical direction while being changed by two dots in a horizontal direction. In addition, the polarity of the pixel signals supplied to all the liquid crystal cells on the liquid crystal display panel 106 is inverted from frame to frame.

In the square inversion system, the liquid crystal display panel 106 is driven so that the polarity of the pixel signal is changed by two dots in a vertical direction and also changed by two dots in a horizontal direction. In addition, the polarity of the pixel signals supplied to all the liquid crystal cells on the liquid crystal display panel 106 is inverted from frame to frame.

In case of the one-dot inversion system, the polarity of the pixel signal supplied to the liquid crystal cell repeats every two liquid crystal cells in the horizontal direction. in case of the horizontal two-dot inversion system, the polarity of the pixel signal supplied to the liquid crystal cell repeats every four liquid crystal cells in the horizontal direction, and in case of the square inversion system, the polarity of the pixel signal supplied to the liquid crystal cell repeats every four liquid crystal cells in the horizontal and vertical directions.

Figure 7:
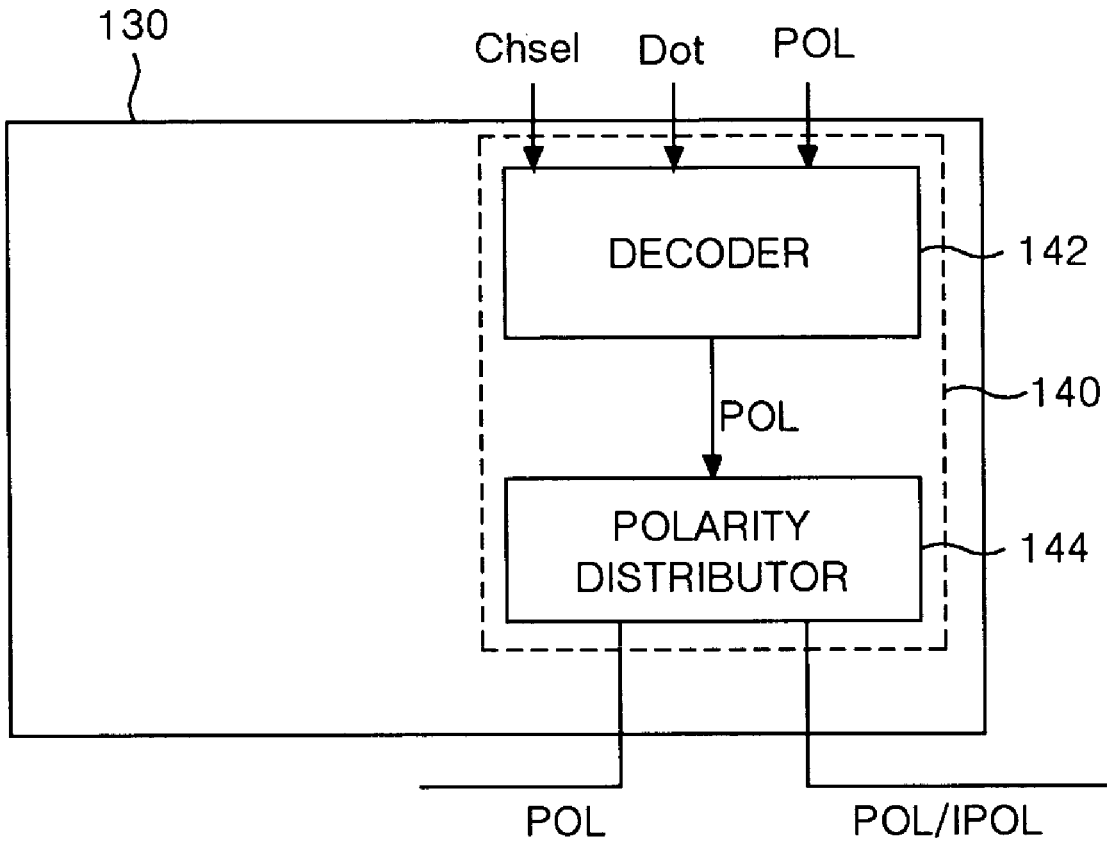
FIG. 7 is a diagram illustrating a timing controller shown in FIG. 6.

The timing controller 130 generates gate control signals such as GSP, GSC, GOE and so on, which control the gate D-IC 104, and data control signals such as SSP, SSC, SOE, POL and so on, which control the data D-IC 110. The timing controller 130 aligns the data signal supplied from a system for the drive of the liquid crystal display panel 106, and supplies the aligned data signal to a plurality of data D-IC 110. Further, the timing controller 130, as shown in FIG. 7, includes a polarity controller 140 that changes the polarity signal POL on the basis of the polarity pattern of the pixel signal displayed in the liquid crystal display panel 106 and the number of output channels of the data D-IC 110 and supplies the changed polarity signal POL to the data D-IC 110.

The timing controller 130 is mounted on the data printed circuit board (PCB) 120. The data PCB 120 is connected to an external system through a user connector. On the data PCB 120, various signal lines are formed for supplying control signals and data signals from the timing controller 130 to each of the data D-IC 110 and each of the gate D-IC 112.

Each of the gate D-IC 112 is mounted on a gate TCP 104 and is electrically connected to gate pads of the liquid crystal display panel 106 through the gate TCP 104. The gate D-IC 112 sequentially drives the gate lines of the liquid crystal display panel 106 during a horizontal period (1H). The gate TCP 104 is connected to the gate PCB 126 which supplies the gate control signals supplied from the timing controller 130 through the data PCB 120 to the gate D-IC 112.

The polarity controller 140 in the timing controller 130 includes a decoder 142 to decode the polarity signal POL of the timing controller 130 on the basis of the number of output channels of the data D-IC 110 and the polarity pattern Dot of the inputted pixel signal; and, a polarity distributor 144 that outputs the polarity signal POL from the decoder 142 as uninverted and inverted signals and to supply the inverted polarity signal to each of the data D-IC 110. For this, the decoder 142 includes a polarity signal input terminal to which the polarity signal POL is supplied from the timing controller 130; a polarity pattern input terminal to which a first selection signal Dot of high state or low state is supplied in accordance with the inversion method of the liquid crystal display panel 106; and a channel selection input terminal to which a second selection signal Chsel corresponding to the number of output channels of the data D-IC 110 is supplied. The decoder 142 transmits the polarity signal POL from the polarity signal input terminal to the polarity distributor 144 in response to the first selection signal Dot and the second selection signal Chsel. The polarity distributor 144 includes a first output terminal and a second output terminal to invert and output the polarity signal POL from the polarity signal input terminal in response to the first selection signal Dot and the second selection signal Chsel.

Each of the first and second selection signals Dot, Chsel is set by design or by a configuration controller and supplied through the data PCB 120.

The first output terminal of the polarity distributor 144 is connected to odd-numbered data D-IC 110 among the plurality of data D-IC 110, and the second output terminal is connected to even-numbered data D-IC 110 among the plurality of data D-IC 110.

The first selection signal Dot, as shown in FIG. 8, has a low state in case that the driving method of the liquid crystal display panel 106 is the one-dot inversion system, and high state in case of the horizontal two-dot or square inversion system. The second selection signal Chsel has a low state in case that the number of output channels of the data D-IC 110 is a multiple of 2, and high state in case of a multiple of 4.

Accordingly, the decoder 142 supplies the polarity signal POL from the polarity signal input terminal to the odd-numbered data D-IC 110 connected to the first output terminal of the polarity distributor 144 and inverts the polarity signal POL to supply the inverted polarity signal to the even-numbered data D-IC 110 connected to the second output terminal of the polarity distributor 144 in case of the first selection signal Dot of high state supplied to the polarity pattern input terminal and the second selection signal Chsel of low state supplied to the channel selection input terminal. However, the decoder 142 supplies the polarity signal POL from the polarity signal input terminal to each of the data D-IC 110 through each of the first output terminal and the second output terminal of the polarity distributor 144 except for the situation where the inputted first selection signal Dot is the high state and second selection signal Chsel is the low state.

In this way, the decoder 142 and the polarity distributor 144 convert the polarity signal POL supplied from the timing controller 130 in accordance with the first selection signal Dot and the second selection signal Chsel to supply to each of the odd-numbered data D-IC 110 and the even-numbered D-IC 110. As a result, the decoder 142 and the polarity distributor 144 matches the number of output channels of the data D-IC 110 with the polarity repetition period of the pixel signal, which is inverted by the inversion driving method of the liquid crystal display panel 106. Accordingly, the decoder 142 and the polarity distributor invert the polarity signal POL supplied to the adjacent data D-IC 110 to control the polarity of the liquid crystal cell of a bordering area of the odd-numbered data D-IC 110 and the even-numbered D-IC 110, thereby avoiding picture quality degradation. The decoder 142 and the polarity distributor 144 may be integrated into the polarity controller 140 for the polarity control.

Each of the data D-IC 110 is mounted on each of the data TCP 108. The data D-IC 110 mounted on the data TCP 108 is electrically connected to data pads of the liquid crystal display panel 106 through the data TCP 108. The data D-IC 110 converts digital pixel data into an analog pixel signal to supply the converted pixel signal to the data lines of the liquid crystal display panel 106 during one horizontal period (1H).

Figure 9:
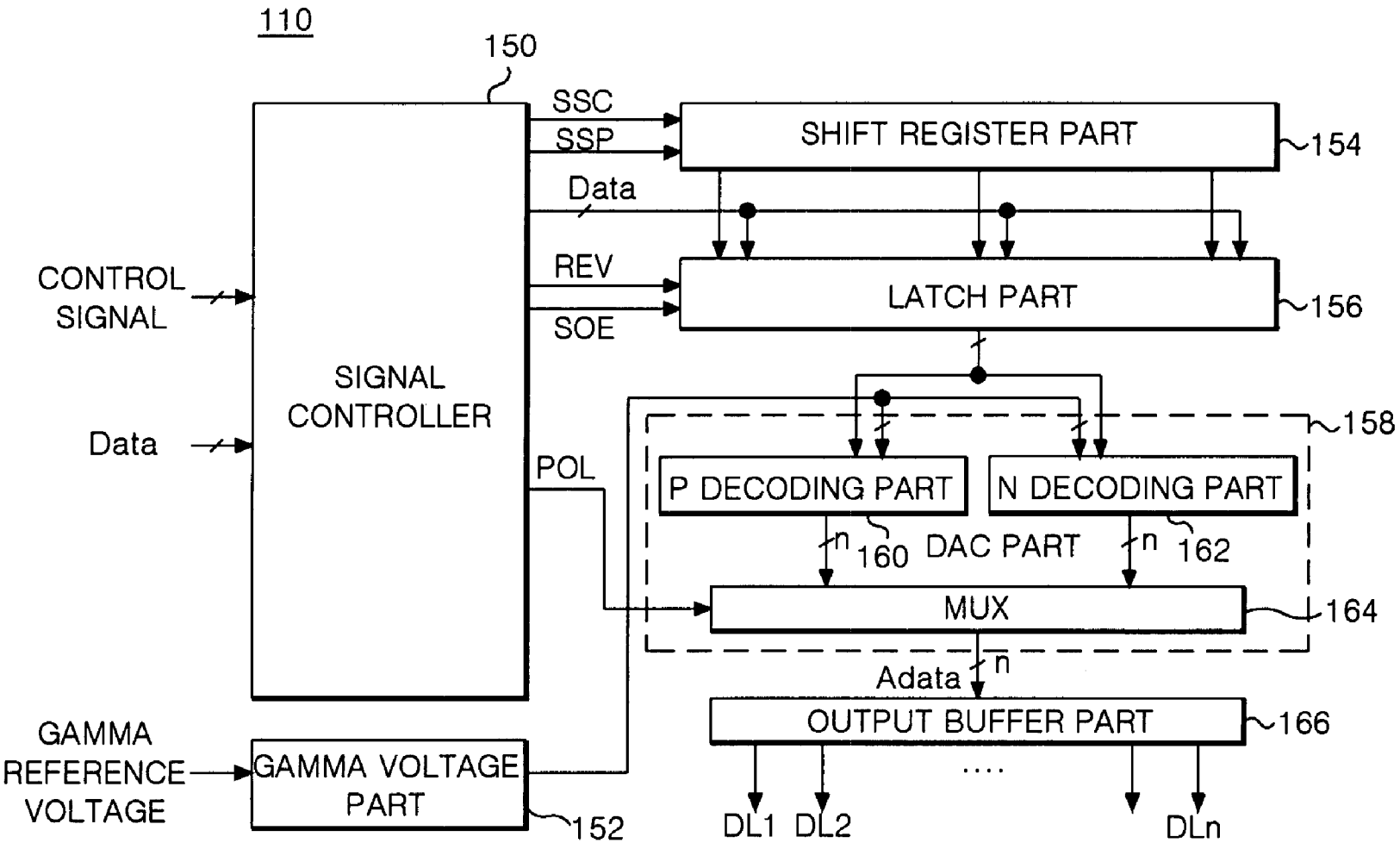
FIG. 9 is a block diagram illustrating a data drive integrated circuit D-IC shown in FIG. 6.

Each of the data D-IC 110, as shown in FIG. 9, includes a shift register part 154 to sequentially supply a sampling signal; a latch part 156 to sequentially latch the digital data Data in response to the sampling signal and at the same time to output the latched digital data; a digital-analog converter (DAC) 158 to convert the digital data Data from the latch part 156 into a pixel signal AData; and an output buffer part 166 to buffer and output the pixel signal AData from the DAC 158.

Each of the data D-IC 110 further includes a signal controller 150 to relay the digital data Data and data control signals SSP, SSC, SOE, REV, POL supplied from the timing controller 130; and, a gamma voltage part 152 to supply positive and negative gamma voltages to the DAC 158. Each of the data D-IC 110 drives data lines DL1 to DLn.

The signal controller 150 operates such that digital data Data, the polarity signal POL converted at and supplied from the decoder 142 and the various data control signals such as SSP, SSC, SOE, REV and so on from the timing controller 130 are outputted to their corresponding components, as previously described.

The gamma voltage part 152 subdivides a plurality of reference gamma voltages supplied from a reference gamma voltage generator (not shown) and outputs them.

Shift registers included in the shift register part 154 sequentially shift the source start pulse SSP from the signal controller 150 in accordance with the source sampling clock signal SSC and output it as a sampling signal.

The latch part 156 sequentially samples the digital data Data from the signal controller 150 and latches the data in response to the sampling signal from the shift register part 154. The latch part 156 is comprised of n latches to latch the digital data Data, and each of the latches has the size corresponding to the number of bits (e.g., 3 bit or 6 bit) of the digital data. The timing controller 130 divides the digital data Data into even data and an odd data and simultaneously outputs the even data and the odd data through corresponding transmission lines in order to reduce a transmission frequency. Each of the even data and the odd data may include red R, green G and blue B data. The latch part 156 simultaneously latches the even data and the odd data, supplied through the signal controller 150 every sampling signal. Subsequently, the latch part 156 simultaneously outputs the values of data Data, which are latched in response to the source output enable signal (SOE) from the signal controller 150. The digital data Data may be modulated to have the number of transition bits reduced, to minimize electromagnetic interference EMI when transmitting data in the timing controller 130, thereby being supplied.

The DAC 158 converts the digital data Data from the latch part 156 into the positive and negative pixel signal AData at the same time. The DAC 158 includes a P (positive) decoding part 160 and an N (negative) decoding part 162 connected to the latch part 156, and a multiplexer MUX part 164 to select the output signal of the P decoding part 160 and the N decoding part 162.

P decoders included in the P decoding part 160 convert n data Data values simultaneously supplied from the latch part 156 into the positive pixel signal AData by use of the positive gamma voltages from the gamma voltage part 152. N decoders included in the N decoding part 162 convert n numbers of data Data values simultaneously supplied from the latch part 156 into the negative pixel signal AData by use of the negative gamma voltages from the gamma voltage part 152. Multiplexers included in the multiplexer part 164 select the positive pixel signal AData from the P decoder 160 or the negative pixel signal AData from the N decoder 162 to output it in response to the polarity signal POL from the decoder 142 through the signal controller 150.

Output buffers included in the output buffer part 166 may be a voltage follower each connected to one of the data lines Dl to Dn. The output buffers buffer the pixel signal AData from the DAC 158 to supply the buffered pixel signal to the data lines DL1 to DLn.

Thus, the driving apparatus of the liquid crystal display device according to the first embodiment converts the digital data Data outputted from the timing controller 130 into the pixel signal AData, which has a polarity pattern determined by the inversion method, using the DAC 158 of the data D-IC 110 to which the positive and negative gamma voltages are supplied from the gamma voltage part 152, and supplies the converted pixel signal AData to the liquid crystal display panel 106, thereby displaying a desired picture in the liquid crystal display panel 106.

The driving apparatus and method of the liquid crystal display device according to the first embodiment inverts the polarity signal POL supplied between the adjacent data D-IC 110 for the repetition period of the polarity pattern of the pixel signal to be matched with the number of output channels of the data D-IC 110 by use of the polarity controller 140 included in the timing controller 130, thereby avoiding a picture quality defect at the bordering area between the adjacent data D-IC 110.

Specifically, in case that the liquid crystal display panel 106 is driven by the one-dot inversion system where the data D-IC 110 has a number of output channels which are a multiple of 2, as shown in FIG. 8, the polarity controller 140 supplies the polarity signal POL to the odd-numbered data D-IC 110 and to the even-numbered data D-IC 110 at the same time. Accordingly, the driving apparatus and method of the liquid crystal display device according to the first embodiment inverts the polarity of the pixel signal, which is supplied to the liquid crystal display panel 106 from the bordering area of the adjacent data-D-IC's 110. That is, the last output channel of the odd-numbered data D-IC 110 and the first output channel of the even-numbered data D-IC 110.

Accordingly, the driving apparatus and method of the liquid crystal display device according to the first embodiment where the liquid crystal display panel 106 is driven by the one-dot inversion system by where the data D-IC 110 having the output channels which a multiple of 2, has a uniform spatial repetition period of the polarity pattern of the pixel signal, wherein the repetition period is in accordance with the number of the output channels of the data D-IC 110, thereby preventing the picture quality degradation caused by the non-uniformity of the polarity pattern of the pixel signal.

Further, in case that the liquid crystal display panel 106 is driven by the one-dot inversion system where the data D-IC 110 has a number of output channels, which are a multiple of 4, as shown in FIG. 8, the polarity controller 140 supplies the polarity signal POL generated from the timing controller 130 to the odd-numbered data D-IC 110 and the even-numbered data D-IC 110. Accordingly, the driving apparatus and method of the liquid crystal display device according to the first embodiment inverts the polarity of the pixel signal, which is supplied to the liquid crystal display panel 106 from the bordering area of the adjacent data D-IC 110. That is, the last output channel of the odd-numbered data D-IC 110 and the first output channel of the even-numbered data D-IC 110.

Accordingly, the driving apparatus and method of the liquid crystal display device according to the first embodiment where the liquid crystal display panel 106 is driven by the one-dot inversion system where the data D-IC 110 has a number of output channels, which is a multiple of 4, has the repetition period of the polarity pattern of the pixel signal uniform by the dot, wherein the spatial repetition period is in accordance with the number of the output channels of the data D-IC 110, thereby preventing the picture quality degradation caused by the non-uniformity of the polarity pattern of the pixel signal.

Figure 10:
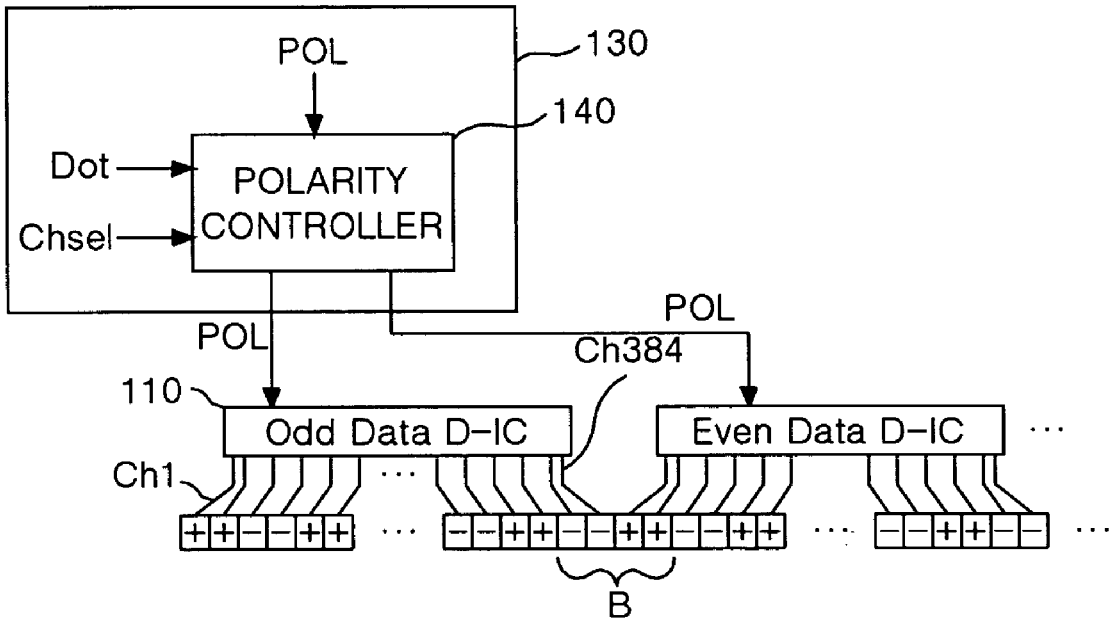
FIG. 10 is a diagram illustrating a polarity pattern of a two-dot inversion system outputted between adjacent D-IC having output channels, of which the number is a multiple of 4, shown in FIG. 6.

In case where the liquid crystal display panel 106 is driven by the horizontal two-dot inversion system using a data D-IC 110 having a output channels, where the number of output channels is a multiple of 4, as shown in FIG. 8, the polarity controller 140 supplies the polarity signal POL generated from the timing controller 130 to the odd-numbered data D-IC 110 and the even-numbered data D-IC 110. Accordingly, the driving apparatus and method of the liquid crystal display device according to the first embodiment inverts the polarity of the pixel signal, which is supplied to the liquid crystal display panel 106 from the bordering area B of the adjacent data D-IC's 110. That is, the last output channel of the odd-numbered data D-IC 110 and the first output channel of the even-numbered data D-IC 110, as shown in FIG. 10.

Accordingly, the driving apparatus and method of the liquid crystal display device according to the first embodiment where the liquid crystal display panel 106 is driven by the horizontal two-dot inversion system and where the number of data D-IC 110 channels is a multiple of 4, has a uniform tow-dot horizontal repetition period of the polarity pattern of the pixel, such the repetition period conforms to the number of the output channels of the data D-IC 110, thereby preventing picture quality degradation caused by the non-uniformity of the polarity pattern of the pixel signal.

Figure 11:
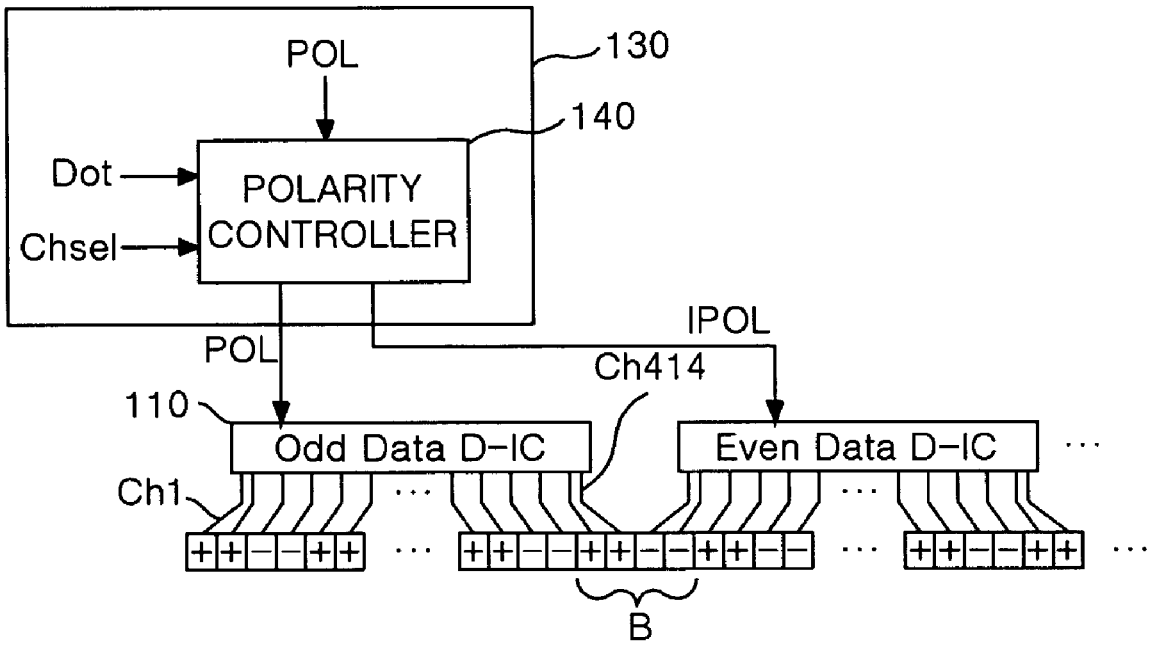
FIG. 11 is a diagram illustrating a polarity pattern of a two-dot inversion system outputted between adjacent D-IC having output channels, of which the number is a multiple of 2 but not of 4, shown in FIG. 6.

In case that the liquid crystal display panel 106 is driven by the horizontal two-dot inversion system where the number of output channels of the data D-IC 110 is a multiple of 2 but not a multiple of 4, as shown in FIG. 8, the timing controller 130 supplies the polarity signal POL generated from the timing controller 130 to the odd-numbered data D-IC 110 and the inverted polarity signal IPOL, such that the polarity signal POL supplied from the timing controller 130 is inverted, to the even-numbered data D-IC 110 by use of the embedded polarity controller 140. Accordingly, the driving apparatus and method of the liquid crystal display device according to the first embodiment inverts the polarity of the pixel signal, which is supplied to the liquid crystal display panel 106 from the bordering area B of the adjacent data D-IC's 110. That is, the last output channel of the odd-numbered data D-IC 110 and the first output channel of the even-numbered data D-IC 110, as shown in FIG. 11.

In case of driving the data D-IC 110 having a number of output channels which are a multiple of 2 but not a multiple of 4, in the horizontal two-dot inversion system, the inverted polarity signal IPOL outputted from the polarity controller 140 embedded in the timing controller 130 is supplied to the even-numbered data D-IC 110. Thus the polarity signals POL, IPOL supplied to the odd-numbered data D-IC 110 and the even-numbered data D-IC 110 are inverted.

Accordingly, the driving apparatus and method of the liquid crystal display device according to the first embodiment where the liquid crystal display panel 106 is driven by the horizontal two-dot inversion system where the data D-IC 110 has output channels, the number of which are a multiple of 2 but not a multiple of 4, has a uniform two-dot horizontal repetition period of the polarity pattern of the pixel signal, such that the repetition period is conforms with the number of the output channels of the data D-IC 110, thereby preventing the picture quality degradation caused by the non-uniformity of the polarity pattern of the pixel signal.

Therefore, the driving apparatus and method of the liquid crystal display device according to the first embodiment inverts the polarity of the pixel signal, which is supplied to the liquid crystal display panel 106 from the bordering area B of the adjacent data D-IC's 110. That is, the last output channel of the odd-numbered data D-IC 110 and the first output channel of the even-numbered data D-IC 110, as shown in FIG. 11.

Figure 12:
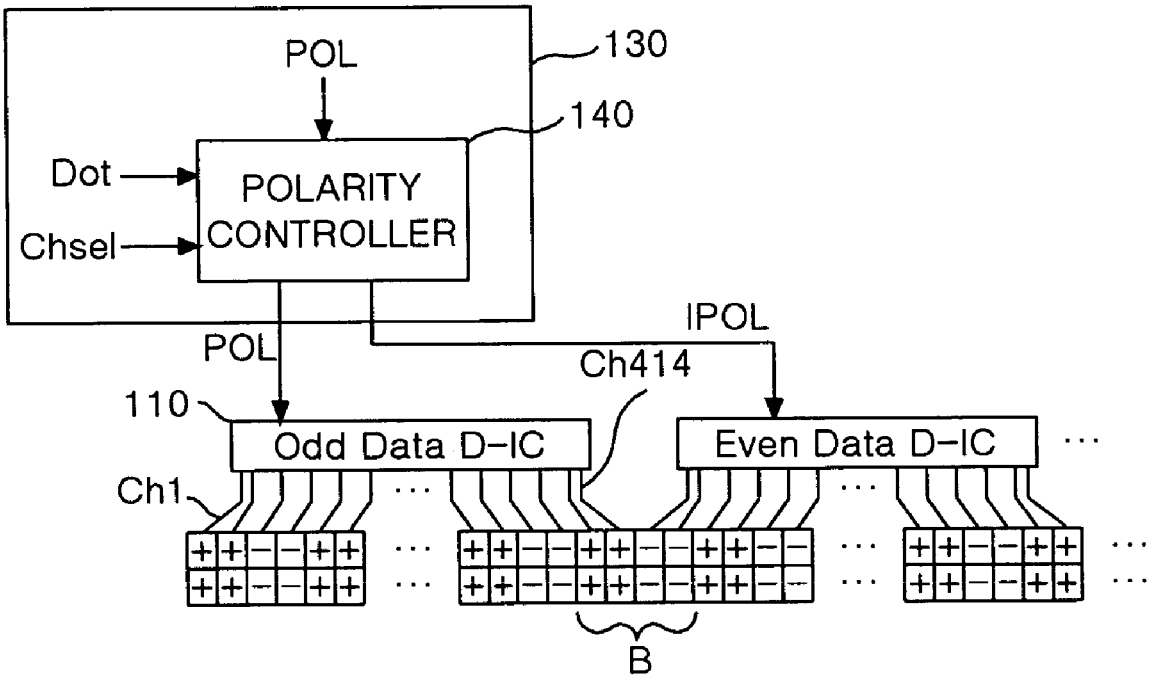
FIG. 12 is a diagram illustrating a polarity pattern of a square inversion system outputted between adjacent D-IC having output channels, of which the number is a multiple of 2 but not of 4, shown in FIG. 6.

On the other hand, in case that the liquid crystal display panel 106 is driven by the square inversion system where the data D-IC 110 has a number of output channels, which are a multiple of 2 but not a multiple of 4, as shown in FIG. 8, the polarity controller 140 supplies the polarity signal POL to the odd-numbered data D-IC 110 and the inverted polarity signal IPOL, which was made by inverting the polarity signal POL, to the even-numbered data D-IC 110. Accordingly, the driving apparatus and method of the liquid crystal display device according to the first embodiment has the polarity of the pixel signal inverted, wherein the pixel signal is supplied to the liquid crystal display panel 106 from the bordering area B between the adjacent data D-IC's 110. That is, the last output channel of the odd-numbered data D-IC 110 and the first output channel of the even-numbered data D-IC 110, as shown in FIG. 12.

Accordingly, the driving apparatus and method of the liquid crystal display device according to the first embodiment where the liquid crystal display panel 106 is driven by the square inversion system where the data D-IC 110 has a number of output channels which are multiple of 2 but not a multiple of 4, has a uniform square pattern repetition period of the polarity pattern of the pixel signal, such that the repetition period is in accordance with the number of the output channels of the data D-IC 110, thereby preventing picture quality degradation caused by the non-uniformity of the polarity pattern of the pixel signal.

Figure 13:
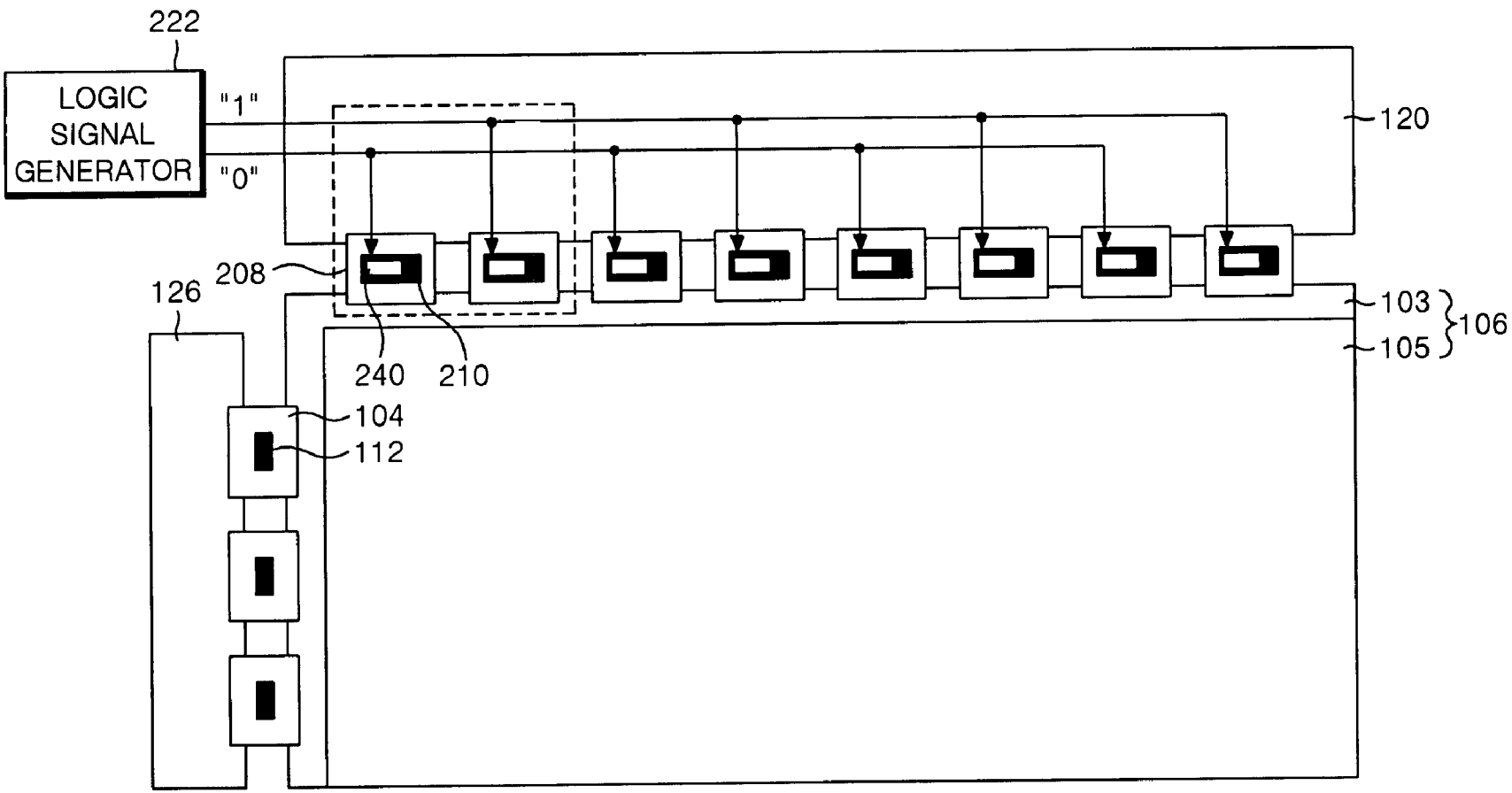
FIG. 13 is a diagram illustrating a driving apparatus of a liquid crystal display device according to a second embodiment.

Referring to FIG. 13, a driving apparatus and method of a liquid crystal display device according to a second embodiment has the decoder 142 and the polarity distributor 144 in the first embodiment integrated together, and a polarity controller 240 embedded in each of the data D-IC 210, wherein a pin receiving an external control signal, i.e., a chip identifier CID other than a polarity control signal POL, a channel selection signal CHSEL, and a dot system signal DOT1, is installed in the polarity controller 240. In the driving apparatus of the liquid crystal display device according to the second embodiment, the explanation is similar to the first embodiment except that logic signal generator 222 is installed supplying logic signals 1, 0 to the chip identifier CID of the D-IC 210 and the data D-IC 210 having an embedded polarity controller 240 *a*.

Figure 14:
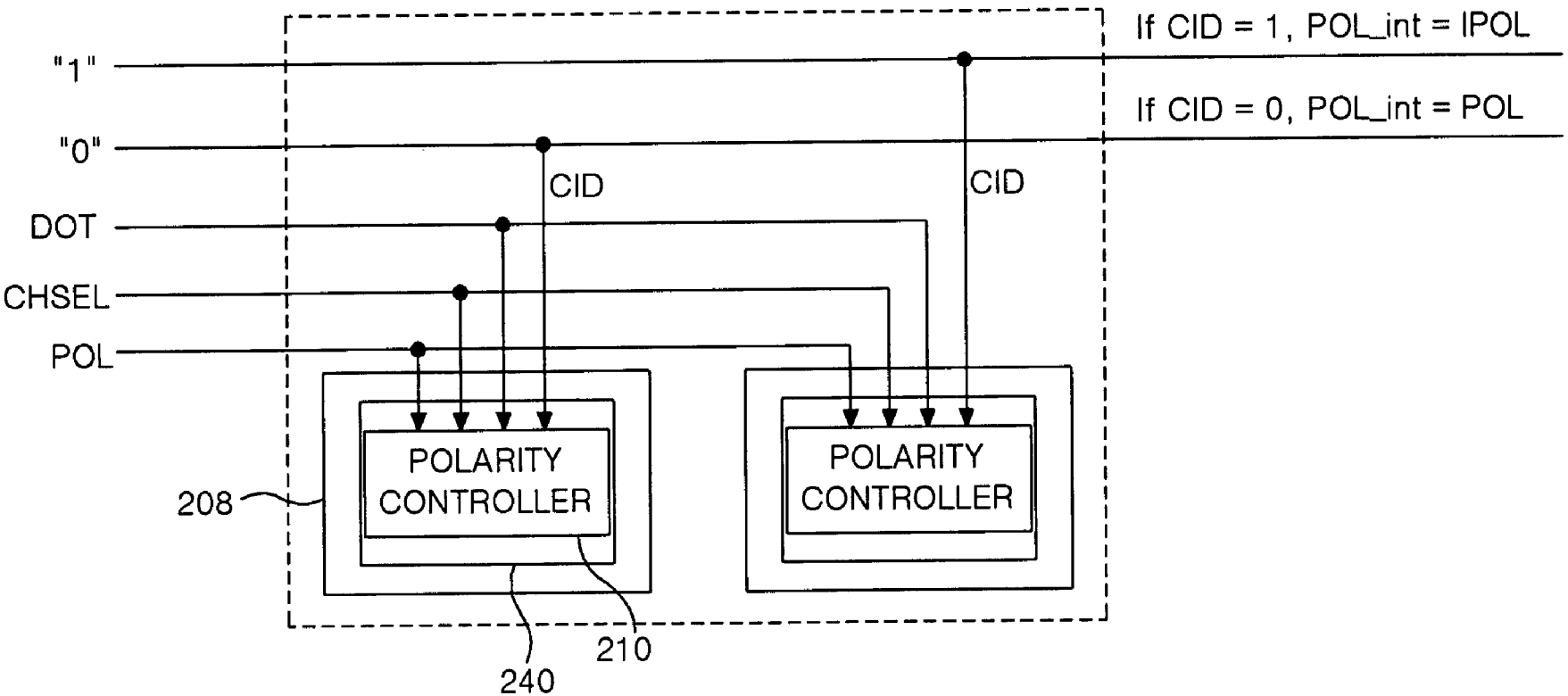
FIG. 14 is an enlarged diagram of "A" of FIG. 13.
Figure 15:
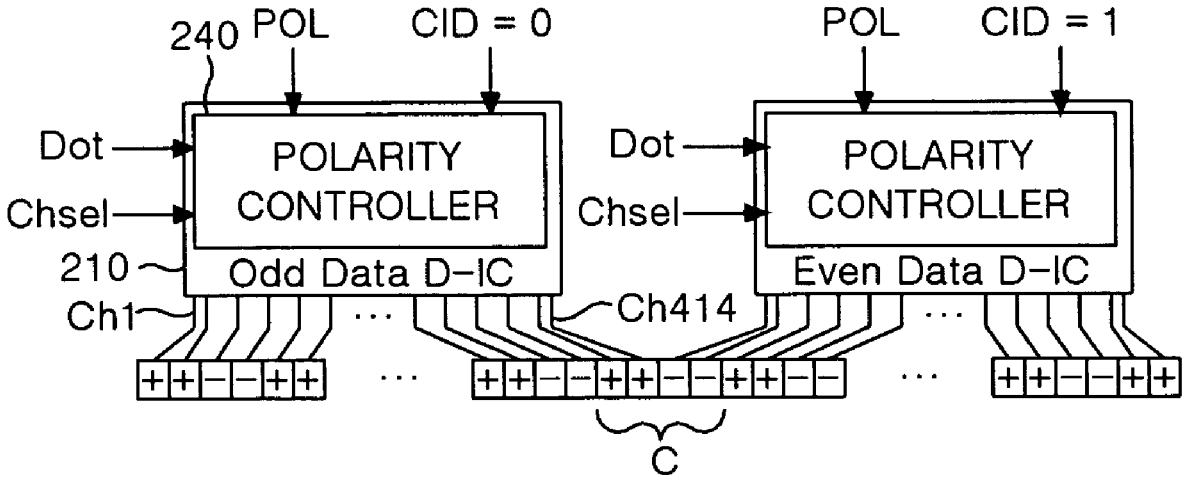
FIG. 15 is a diagram illustrating a polarity pattern of a two-dot inversion system outputted between adjacent D-IC's having output channels, of which the number is a multiple of 2 but not of 4, shown in FIG. 13.

Referring to FIG. 14, the polarity controller 240 is embedded in each data D-IC 210. The logic signal 1, 0 of the logic signal generator 222 is supplied to the polarity controller 240 embedded in each of the data D-IC 210. Further, a first selection signal Dot of high state or low state and a second selection signal Chsel corresponding to the number of output channels of the data D-IC 210 in accordance with the inversion system of the liquid crystal display panel 106 through a data printed circuit board PCB 120 and the polarity signal POL are supplied to each of the polarity controller 240. The polarity controller 240 embedded in each of the data D-IC 210 generates the polarity signal POL in accordance with the logic signal 1, 0 supplied from the logic signal generator 222 on the basis of the first and second selection signals. The polarity signal POL determines the polarity of the data D-IC 210. That is, in each of the odd-numbered data D-IC 210, the first logic signal 0 is supplied from the logic signal generator 222 to the chip identifier CID. In each of the even-numbered data D-IC 210, the second logic signal 1 is supplied from a signal supply line to the chip identifier CIP. The polarity controller 240 embedded in the odd-numbered data D-IC 210, which receives the first logic signal 0 through the chip identifier CID, generates the polarity signal in accordance with the chip identifier CID=0 to determine the polarity POL of the data D-IC 210. The polarity controller 240 embedded in the even-numbered data D-IC 210, which receives the second logic signal 1 through the chip identifier CID, generates the inverted polarity signal in accordance with the chip identifier CID=1 to determine the inverted polarity IPOL of the data D-IC 210.

Thus, the driving apparatus and method of the liquid crystal display device according to the second embodiment has the repetition period of the polarity pattern of the pixel signal matched with the number of the output channels of the data D-IC 210 by use of the chip identifier CID and the polarity controller 240 embedded in the data D-IC 210, thereby avoiding the picture quality degradation in the bordering area between the adjacent data D-IC's 210.

Figure 16:
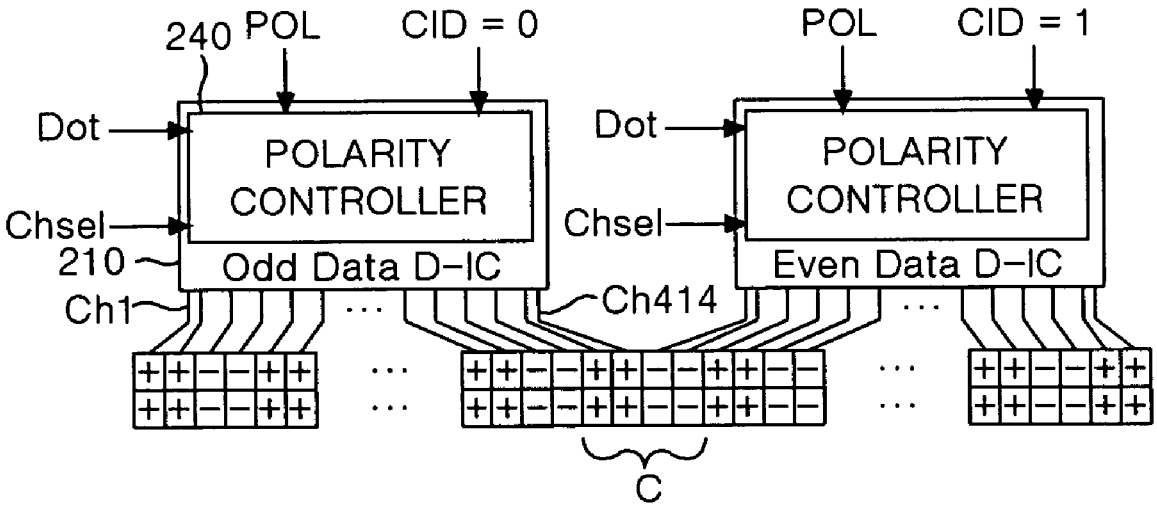
FIG. 16 is a diagram illustrating a polarity pattern of a square inversion system outputted between adjacent D-IC's having output channels, of which the number is a multiple of 2 but not of 4, shown in FIG. 13.

As explained in the driving apparatus and method of the liquid crystal display device according to the first embodiment, in case of driving the liquid crystal display panel 106 by the one-dot inversion system and the liquid crystal display panel 106 having output channels, which area multiple of 4, by the horizontal two-dot inversion system, the same logic signal is supplied as the logic signal supplied to the chip identifier CID so that the polarity signal POL between the adjacent data D-IC's 210 is not inverted. Accordingly, the repetition period of the polarity pattern of the pixel signal is uniform regardless of the number of output channels of the data D-IC 210, thereby avoiding picture quality degradation caused by the non-uniformity of the polarity pattern of the pixel signal.

Where the polarity controller 240 is embedded in the odd-numbered data D-IC 210 is as shown in FIG. 16, and the liquid crystal display panel 106 is driven by the horizontal two-dot inversion system by use of the data D-IC 210 having output channels of the number of which is a multiple of 2 but not a multiple of 4: e.g., 414 channels. That is, the odd-numbered data D-IC 210 has the polarity POL on the basis of the polarity signal POL, the channel selection signal CHSEL, the dot system signal DOT1 and the first logic signal 0 supplied to the chip identifier CID of the embedded polarity controller 240. On the other hand, the even-numbered data D-IC 210 has the inverted polarity IPOL on the basis of the polarity signal POL, the channel selection signal CHSEL, the dot system signal DOT1 and the second logic signal 1 supplied to the chip identifier CID of the embedded polarity controller 240. Accordingly, the driving apparatus and method of the liquid crystal display device according to the second embodiment inverts the polarity of the pixel signal which is supplied to the liquid crystal display panel 106 from the bordering area C of the adjacent data D-IC 210. That is, the last output channel of the odd-numbered data D-IC 210 and the first output channel of the even-numbered data D-IC 210. Thus, in case of driving the data D-IC 210 having the a number of output channels, which are a multiple of 2 but not a multiple of 4, by the horizontal two-dot inversion system, the odd-numbered data D-IC 210 has the polarity signal POL and the even-numbered data D-IC 210 has the inverted polarity signal IPOL. Further, even in the method of driving the liquid crystal display panel 106 having a number of channels which is not a multiple of 4, as shown in FIG. 17, the logic signal "0" is supplied to the odd-numbered data D-IC 210 and the logic signal "1" is supplied to the even-numbered data D-IC 210, thereby inverting the polarity. Accordingly, the polarity between the odd-numbered last two channels and the even-numbered beginning two channels alternates.

As described above, the driving apparatus and method of the liquid crystal display device includes the data D-IC and the timing controller embedding the decoder that changes the polarity signal on the basis of the polarity pattern of the pixel signal displayed in the liquid crystal display panel and the number of output channels of the data drive integrated circuit, and supplies the changed polarity signal to the data drive integrated circuit. Accordingly, the repetition period of the polarity pattern of the pixel signal is uniform in accordance with the number of the output channels of the data drive integrated circuit. This may avoid the picture quality degradation caused by the non-uniformity of the polarity pattern of the pixel signal generated at the bordering area between the adjacent data drive integrated circuits.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus of a liquid crystal display device, comprising:

a liquid crystal display having a plurality of input channels;

a plurality of data drive circuits that generate a video signal having a polarity pattern in accordance with a polarity signal and supply the video signal to the input channels of the liquid crystal display through a plurality of output channels;

a timing controller that generates the polarity signal; and a polarity controller in the timing controller that changes the polarity signal on the basis of a first selection signal corresponding to a number of the output channels of each of the data drive circuits and a second selection signal corresponding to a repetition period of the polarity pattern of the video signal displayed in the liquid crystal display panel and supplies the changed polarity signal to the data drive circuits wherein the polarity controller includes a decoder to decode the polarity signal of the timing controller on the basis of the first selection signal and the second selection signal and a polarity distributor to receive the polarity signal from the decoder, wherein the decoder includes a polarity signal input terminal to which the polarity signal is supplied from the timing controller, a polarity pattern input terminal to which the first selection signal of high state or low state is supplied in accordance with a inversion method of the liquid crystal display panel and a channel selection input terminal to which the second selection signal corresponding to the number of output channels of the data drive circuits is supplied, wherein the decoder transmits the polarity signal from the polarity signal input terminal to the polarity distributor in response to the first selection signal and the second selection signal, wherein the polarity distributor converts the polarity signal into at least one of a non-inverted polarity signal and an inverted polarity signal and then supplies at least one of the non-inverted polarity signal and the inverted polarity signal to the data drive circuits, wherein the polarity distributor includes a first output terminal and a second output terminal, wherein the first output terminal of the polarity distributor is connected to odd-numbered data drive circuits among the plurality of data drive circuits and the second output terminal of the polarity distributor is connected to even-numbered data drive circuits among the plurality of data drive circuits, wherein the second selection signal has a low state in case that the number of output channels of the data drive circuits is a multiple of 2, and high state in case of a multiple of 4.

2. The driving apparatus according to claim 1, wherein the polarity distributor supplies at least one of the non-inverted polarity signal and the inverted polarity signal to an odd-numbered data drive circuit among the plurality of data drive circuits, and supplies at least one of the non-inverted polarity signal and the inverted polarity signal to an even-numbered data drive circuit among the plurality of data drive circuits.

3. The driving apparatus according to claim 1, wherein the polarity pattern is at least one of:

a first polarity pattern that is alternated by one liquid crystal cell in horizontal and vertical directions of the liquid crystal display;

a second polarity pattern that is alternated by two liquid crystal cells in the horizontal direction of the liquid crystal display and by one liquid crystal cell in the vertical direction of the liquid crystal display; or a third polarity pattern that is alternated by two liquid crystal cells in the horizontal direction and two liquid crystal cells in the vertical direction of the liquid crystal display, wherein the first selection signal has a low state in case that the polarity pattern is the first polarity pattern and a high state in case that the polarity pattern is at least one of the second polarity pattern and the third polarity pattern.

4. A driving apparatus of a liquid crystal display device, comprising:

a liquid crystal display having a plurality of input channels;

a plurality of data drive circuits that generate a video signal having a polarity pattern in accordance with a polarity signal and supply the video signal to the input channels of the liquid crystal display through a plurality of output channels;

a logic signal generator to generate first logic signal and second logic signal that controls the polarity signal; and a polarity controller to convert the polarity signal in accordance with the logic signal and supply the polarity signal to the data drive circuits, wherein the polarity signal is based on a first selection signal corresponding to the number of the output channels in each of the plurality of data drive circuits and a second selection signal corresponding to a repetition period of the polarity pattern, wherein the polarity controller is embedded in each of the plurality of data drive circuits, wherein the plurality of data drive circuits generate the polarity signal on accordance with the logic signal supplied from the logic signal generator on the basis of the first and second selection signals, wherein the first logic signal is supplied to a chip identifier of an odd-numbered data drive circuit among the plurality of data drive circuits, and the second logic is supplied to a chip identifier of an even-numbered data drive circuit among the plurality of data drive circuits, wherein the polarity controller embedded in the odd-numbered data drive circuit, which receives the first logic signal through the chip identifier, generates the polarity signal in accordance with the chip identifier to determine the polarity signal of the odd-numbered data drive circuit, wherein the polarity controller embedded in the even-numbered data drive circuit, which receives the second logic signal through the chip identifier, generates the polarity signal in accordance with the chip identifier to determine the polarity signal of the even-numbered data drive circuit.

5. The driving apparatus according to claim 4, wherein the logic signal includes:

the first logic signal that controls the polarity signal such that the polarity signal is not inverted; and the second logic signal that controls the polarity signal such that the polarity signal is inverted.

6. The driving apparatus according to claim 4, wherein the polarity pattern is at least one of:

a first polarity pattern that is alternated by one of the liquid crystal cells in a horizontal and a vertical direction of the liquid crystal display;

a second polarity pattern that is alternated by two liquid crystal cells in the horizontal direction of the liquid crystal display panel and by one liquid crystal cell in the vertical direction of the liquid crystal display; or a third polarity pattern that is alternated by two liquid crystal cells in the horizontal direction and two liquid crystal cells in the vertical direction of the liquid crystal display.

7. A driving method of a liquid crystal display device having a liquid crystal display which includes liquid crystal cells disposed in a matrix shape to display a video signal, a plurality of data drive circuits that generate a polarity pattern of the video signal to supply the polarity pattern to the liquid crystal cell through a plurality of output channels, and a timing controller to control the data drive circuits, the method comprising:

generating a polarity signal;

generating the polarity pattern of the video signal in accordance with the polarity signal by controlling the polarity signal in accordance with the number of the output channels of each of the plurality of data drive circuits changing the polarity signal on the basis of a first selection signal corresponding to a number of the output channels of each of the data drive circuits and a second selection signal corresponding to a repetition period of the polarity pattern of the video signal displayed in the liquid crystal display panel and supplies the changed polarity signal to the data drive circuits;

wherein the polarity controller includes a decoder to decode the polarity signal of the timing controller on the basis of the first selection signal and the second selection signal and a polarity distributor to receive the polarity signal from the decoder, wherein the decoder includes a polarity signal input terminal to which the polarity signal is supplied from the timing controller, a polarity pattern input terminal to which the first selection signal of high state or low state is supplied in accordance with a inversion method of the liquid crystal display panel and a channel selection input terminal to which the second selection signal corresponding to the number of output channels of the data drive circuits is supplied, wherein the polarity distributor converts the polarity signal into at least one of a non-inverted polarity signal and an inverted polarity signal and then supplies at least one of the non-inverted polarity signal and the inverted polarity signal to the data drive circuits, wherein the polarity distributor includes a first output terminal and a second output terminal, wherein the first output terminal of the polarity distributor is connected to odd-numbered data drive circuits among the plurality of data drive circuits and the second output terminal of the polarity distributor is connected to even-numbered data drive circuits among the plurality of data drive circuits.

8. The driving method according to claim 7, wherein generating the polarity pattern comprises at least one of:

generating a first polarity pattern where positive and negative polarities are alternated by one of the liquid crystal cells in a horizontal and vertical direction of the liquid crystal display;

generating a second polarity pattern where positive and negative polarities are alternated by two liquid crystal cells in the horizontal direction of the liquid crystal display panel and by one of the liquid crystal cells in the vertical direction of the liquid crystal display; or generating a third polarity pattern where positive and negative polarities are alternated by two liquid crystal cells in the horizontal and the vertical direction of the liquid crystal display.

9. The driving method according to claim 8, wherein generating the polarity pattern includes:

generating the first selection signal that is at least one of a first logic state corresponding to the number of the output channels and a second logic state being different from the first logic state;

generating the second selection signal of the first logic state corresponding to the first to third polarity patterns; and generating the second selection signal of the second logic state corresponding to a polarity pattern, of which the state is different from the first logic state.

10. The driving method according to claim 7, wherein controlling the polarity signal in accordance with the number of output channels of the each of the plurality of data drive circuits by use of the polarity controller embedded in the timing controller includes:

generating at least one of the polarity signal of the first logic state and the polarity signal of the second logic state, which is inverted from the first polarity state, by use of the decoder; and supplying the first logic signal to the odd-numbered data drive circuit among the plurality of data drive circuits and supplying at least one of the polarity signals of the first and second logic states to the even-numbered data drive circuit among the plurality of data drive circuits, by use of the polarity distributor.

11. A driving method of a liquid crystal display device having a liquid crystal display which includes liquid crystal cells disposed in a matrix shape to display a video signal, and a plurality of data drive circuits that generates a polarity pattern of the video signal to supply the polarity pattern to the liquid crystal cells through a plurality of output channels, the method comprising:

generating a polarity signal;

generating a first logic signal and a second logic signal that is different from the first logic signal;

controlling the polarity signal in accordance with the first and second logic signals according to the number of the output channels by use of the polarity controller included in each data drive circuit; and generating the polarity pattern of the video signal in accordance with the polarity signal supplied from the polarity controller, wherein the polarity controller embedded in each of the plurality of data drive circuits, wherein the plurality of data drive circuits generate the polarity signal on accordance with the first and second logic signals on the basis of first and second selection signals, wherein the first logic signal is supplied to a chip identifier of an odd-numbered data drive circuit among the plurality of data drive circuits, and the second logic is supplied to a chip identifier of an even-numbered data drive circuit among the plurality of data drive circuits, wherein the polarity controller embedded in the odd-numbered data drive circuit, which receives the first logic signal through the chip identifier, generates the polarity signal in accordance with the chip identifier to determine the polarity signal of the odd-numbered data drive circuit, wherein the polarity controller embedded in the even-numbered data drive circuit, which receives the second logic signal through the chip identifier, generates the polarity signal in accordance with the chip identifier to determine the polarity signal of the even-numbered data drive circuit.

12. The driving method according to claim 11, wherein generating the polarity pattern comprises at least one of:

generating a first polarity pattern where positive and negative polarities are alternated by one of the liquid crystal cells in a horizontal and a vertical direction of the liquid crystal display;

generating a second polarity pattern where positive and negative polarities are alternated by two liquid crystal cells in the horizontal direction of the liquid crystal display and by one of the liquid crystal cells in the vertical direction of the liquid crystal display; or generating a third polarity pattern where positive and negative polarities are alternated by two liquid crystal cells in the horizontal and the vertical direction of the liquid crystal display panel.

13. The driving method according to claim 11, wherein controlling the polarity signal in accordance with the first and second logic signals and wherein the polarity signal is generated on the basis of the first and second selection signals in accordance with the number of the output channels by use of the polarity controller embedded in each of data drive circuits includes at least one of:

determining the polarity signal of each of the data drive circuits as a polarity signal corresponding to the first logic signal; or determining an inverted polarity signal in comparison with a polarity signal corresponding to the first logic signal by having the polarity signal of each data drive circuit correspond to the second logic signal.

* * * * *